US008499707B2

(12) United States Patent
Halfon

(10) Patent No.: US 8,499,707 B2
(45) Date of Patent: Aug. 6, 2013

(54) RESCUE BOAT

(71) Applicant: Leon Halfon, Los Angeles, CA (US)

(72) Inventor: Leon Halfon, Los Angeles, CA (US)

( * ) Notice: Subject to any disclaimer, the term of this patent is extended or adjusted under 35 U.S.C. 154(b) by 0 days.

(21) Appl. No.: 13/666,535

(22) Filed: Nov. 1, 2012

(65) Prior Publication Data

US 2013/0104792 A1 May 2, 2013

Related U.S. Application Data

(63) Continuation-in-part of application No. 12/646,935, filed on Dec. 23, 2009, now abandoned.

(51) Int. Cl.
*B63B 43/06* (2006.01)

(52) U.S. Cl.
USPC ..... 114/121; 114/125; 441/65; 441/74

(58) Field of Classification Search
USPC ..... 114/121, 125, 126, 140, 288; 441/65, 441/74
See application file for complete search history.

(56) References Cited

U.S. PATENT DOCUMENTS

| | | | | |
|---|---|---|---|---|
| 2,997,974 | A * | 8/1961 | Hamlin | 114/142 |
| 3,330,228 | A | 7/1967 | Donnelly | |
| 3,422,778 | A | 1/1969 | Halfon | |
| 3,503,358 | A | 3/1970 | Moesly | |
| 3,780,686 | A * | 12/1973 | Brill | 114/267 |
| 3,859,681 | A | 1/1975 | Mc Vay et al. | |
| 3,956,785 | A | 5/1976 | Halfon | |
| 5,000,106 | A | 3/1991 | Rheney | |
| 5,421,283 | A | 6/1995 | Bruggemann et al. | |
| 5,429,066 | A | 7/1995 | Lewit et al. | |
| 5,645,003 | A * | 7/1997 | Grinde | 114/125 |
| 6,726,865 | B2 | 4/2004 | Mielke et al. | |
| 6,736,689 | B2 | 5/2004 | Renard et al. | |
| 7,331,835 | B2 | 2/2008 | Renard et al. | |

FOREIGN PATENT DOCUMENTS

| | | |
|---|---|---|
| WO | WO 0210011 | 2/2002 |
| WO | WO 2005009833 A2 | 2/2005 |

* cited by examiner

*Primary Examiner* — Lars A Olson
*Assistant Examiner* — Anthony Wiest
(74) *Attorney, Agent, or Firm* — Kenneth L. Green

(57) ABSTRACT

A multi-purpose boat has a two angle V hull with a rounded fore-aft profile and slightly convex deck. The hull has steeply angled edge portions and shallowly angled center portions. The edge portions are sufficiently sloped away from vertical to allow the boat to be lifted and not pushed by waves. The rounded fore-aft profile allows the boat to slide over waves, especially during a beach entry. The boat includes a keel having a horizontal base and separating downward from the hull at the fore and aft of the boat to resist yawing. The dry weight of the boat is about 25 pounds with a foam core with a resin coating and the keel is preferably hollow and includes ports to allow water to enter the keel to add about 25 pounds after entering the water. Approximately four inches of free-board is provided separating riders from cold water and predators.

12 Claims, 17 Drawing Sheets

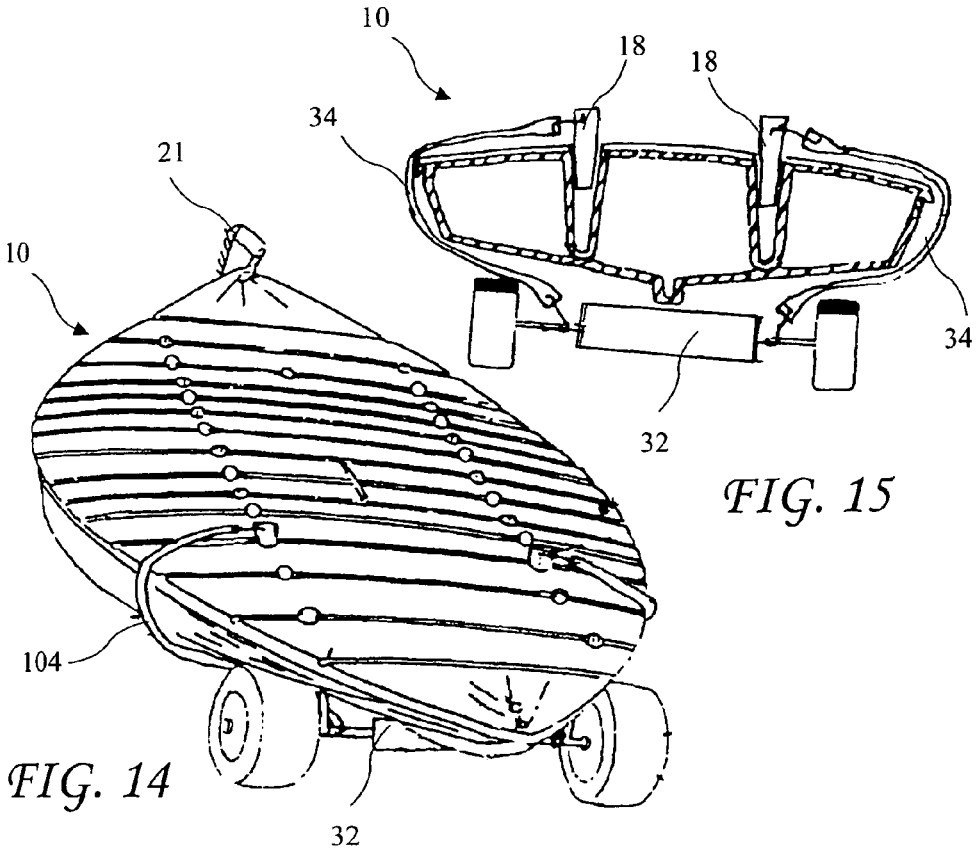
FIG. 15
FIG. 14
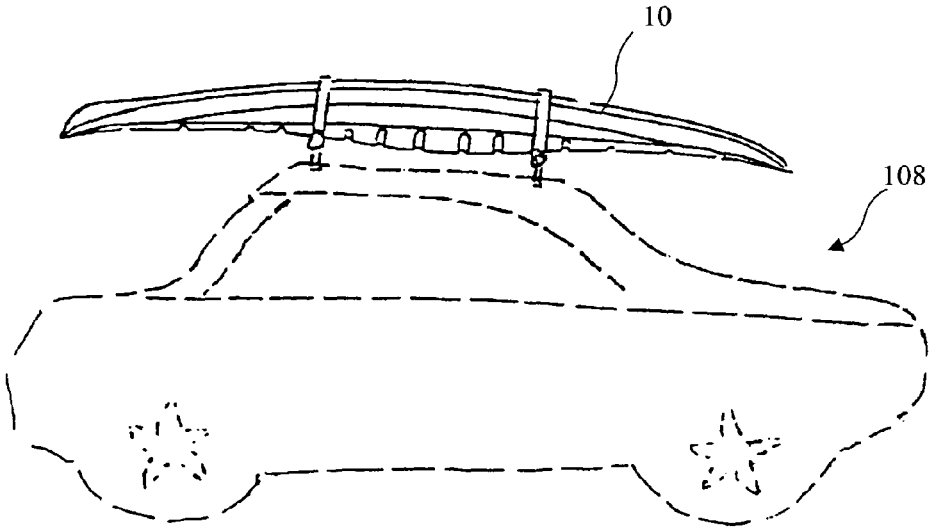
FIG. 16

RESCUE BOAT

The present application claims the priority of U.S. Provisional Patent Application Ser. No. 61/141,222 filed Dec. 29, 2008, and of U.S. Provisional Patent Application Ser. No. 61/168,147 filed Apr. 9, 2009, and of U.S. patent application Ser. No. 12/646,935 filed Dec. 23, 2009, which applications are incorporated in their entirety herein by reference.

BACKGROUND OF THE INVENTION

The present invention relates to small boats and in particular to a small multi-function boat suitable for recreational use and water rescue.

Known small boats are constructed with a sitting compartment which may fill with water. Such known small boats also often lack stability in rough water, and in the event of rough swells, may fill and sink, or in very cold water, may fill subjecting passengers to hypothermia. Further, beach rescue often requires passing through waves and may prove to be problematic due to difficulty in handling the small boats and may result in injury. Known small boats are also heavy and not easily carried or deployed (e.g., thrown from the deck of a larger ship into the water) by a single person.

Other rescue devices are known, such as flat rescue boards. Unfortunately, such rescue boards have limited utility because they have very little freeboard and a victim carried by the board may be subject to both exposure to cold water, and to attack by marine life. Further, such rescue boards do not provide a stable platform for first aid, such as CPR and/or resuscitation. Therefore, known boats are limited when used in rescue operations.

BRIEF SUMMARY OF THE INVENTION

The present invention addresses the above and other needs by providing a multi-purpose boat which has a two angle V hull with a rounded fore-aft profile and slightly convex deck. The hull has steeply angled edge portions and shallowly angled center portions. The edge portions are sufficiently sloped away from vertical to allow the boat to be lifted and not pushed by waves. The rounded fore-aft profile allows the boat to slide over waves, especially during a beach entry. The boat includes a keel having a horizontal base and separating downward from the hull at the fore and aft of the boat to resist yawing. The dry weight of the boat is about 25 pounds with a foam core with a resin coating and the keel is preferably hollow and includes ports to allow water to enter the keel to add about 25 pounds after entering the water. Approximately four inches of freeboard is provided separating riders from cold water and predators.

In accordance with one aspect of the invention, there is provided a multi-purpose boat having a unique banana shape providing safe stable use in rough water and large swells, and for entering the water from a beach through surf. The boat is able to ride large swells remaining upright, thereby keeping riders safe from cold water and predators until assistance arrives.

In accordance with another aspect of the invention, there is provided a foam filled and thereby unsinkable boat. The boat may be constructed having a foam core inside a layer of fiberglass or similar material with a resin coating. The resulting structure is free of seams thus reducing or eliminating weak points and is designed to withstand crashing waves or rocky coastlines with minimal damage.

In accordance with yet another aspect of the invention, there is provided a boat preferably weighing no more than 25 pounds dry. The boat may be stored on large boats or ships and thrown into the water by a single person if an evacuation becomes necessary. The boat may further be carried by a single person from a storage area along the beach to a water entry point. When the boat is first placed it the water, if the boat is lands upside down, it is easily flipped to being upright because of the light weight.

In accordance with still another aspect of the invention, there is provided a boat having an outside edge and top surface free of sharp protrusion allowing evacuated riders to easily climb onto the boat. The boat has a shallow rounded bottom allowing one side or end the boat to dip into the water to further allow evacuated riders to easily climb onto the boat.

In accordance with another aspect of the invention, there is provided a banana shaped (or rounded convex) hull design which allows the boat to rise when rushed by water, thereby withstanding large swells. Such design allows the boat to sit deeper in the water so that the water resists excessive rolling, providing needed stability.

In accordance with another aspect of the invention, there is provided a grooved deck top. The grooves allow water to spill from the boat, keeping riders dry in rough swells.

In accordance with another aspect of the invention, there is provided a rescue boat having a low, flat design, sitting only one-quarter of its depth above water with no fins or other protrusions. The boat's design makes climbing aboard from the water easy, without risk of injury. As a rescue device, because of the lack of protrusions on the deck, the boat can be easily flipped once thrown in the water by grabbing the keel and pushing down on one edge to leverage the boat to the upright. The boat is further designed so that the weight of an individual standing at the end of the boat will push that end into the water, so that an injured rescue victim can be easily slid on to the boat. The boat's design also allows it be used for rescue in situations where an individual is trapped in broken ice. The boat's design keeps individuals safe from cold water (hypothermia) and predators without the necessity of life jackets until help arrives. The boat is further designed to serve as a stable rescue diving platform and provides a solid foundation for performing CPR. The boat's flat upper surface allows individuals to stand, making it easier to see and be seen by rescuers. The boat is light weight and provides low wind resistant allowing it to be easily transported on top of most cars, for example, to transport for rescue in flood conditions.

In accordance with another aspect of the invention, there is provided a multi-function boat. Multi-functionality is achieved by the boat's design features and accessories which allow it to be rapidly and easily adjusted for multiple uses, including paddling, surfing, working out, diving, motoring, sailing, and fishing. Accessories include attachable seats, sail, mast, tiller, motor mount, utility box and twelve foot long paddle. The boat may be paddled standing up, seated or lying down. Upright paddling provides an aerobic workout, improving balance and coordination. Increased stability provided by the boat's design enables the individual to stay aboard for longer periods in order to achieve greater enjoyment and superior health benefits. The boat is designed so that it can be used in oceans, lakes, rivers, ponds, and public beaches. The boat is light weight and has low wind resistance allowing easy transportation on top of most cars to a recreational location.

In accordance with another aspect of the invention, there is provided a method for manufacturing a rescue boat to obtain strength and light weight. The method includes step of: covering the interiors of a mold top section and a mold bottom section with contact cement; laying fiberglass in the mold sections over the contact cement; applying resin to the fiberglass in keel portions of the mold interiors; laying a barrier over the keel portion to make a hollow keel; adding fiberglass over barrier; inserting plastic tubing sections into the mold top section to mold rope passages into the interior of the rescue boat; placing the mold top section onto the mold bottom section; pouring foam into mold; letting the foam expand, harden, and penetrate into the fiberglass; separating the mold sections; applying a coat of a flexible resin to the exposed fiberglass of the rescue boat. The barrier over the keel portion is preferably convex or half round to increase the empty volume of the keel. The keel is formed with at least one port, and preferably two vertically spaced apart ports to allow water to enter and exit the hollow keel. Using the method, the boat is constructed from only about two pounds of fiberglass, four pounds of resin, and 19 pounds of foam, providing about 15 pounds of weight savings over known methods which use much more resin. Further, the foam impregnated fiberglass is much more resistant to impacts which often crack brittle resin impregnated fiberglass.

In accordance with still another aspect of the invention, there is provided a rescue boat including a vertical passage through the boat to a ballast volume in the keel. The keel includes passages allowing water to enter the keel when the boat is in the water. The vertical passage, combined with the rescue boat buoyancy, allow water collected on the deck to escape into the ballast volume to keep the deck dry.

In accordance with still another aspect of the invention, there is provided a rescue boat including replaceable keels. The keels are removably attachable to the rescue boat allowing modifications for different uses. A shallow keel is preferred for general use, and a deep keep is preferred when greater roll stability is desired, for example, by divers climbing onto the rescue boat carrying heavy air tanks.

In accordance with yet another aspect of the invention, there is provided a rescue boat manufactured in a spin mold. Manufacturing in a spin mold provides a very light rescue boat allowing a user to easily place the rescue boat into the water.

In accordance with another aspect of the invention, there is provided a very light weight rescue boat having a thin shell. The thin shell reduces rigidity of the rescue boat and an air valve is attached or molded to the shell to allow filling with low pressure air to provide a increased rigidity.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein:

FIG. 14 shows a top perspective view of the boat with wheels attached for easy transporting.

FIG. 15 shows attachment of wheels using bungee cords and inserts inserted into accessory recesses in the boat.

FIG. 16 shows boat strapped to the top of a car.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
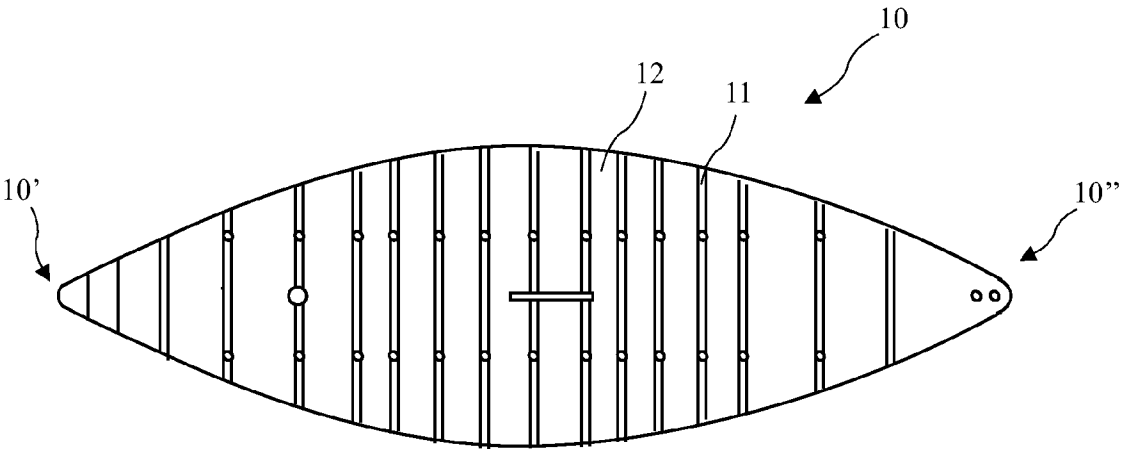
FIG. 1B is a top view of the multi-function boat according to the present invention.
Figure 1A:
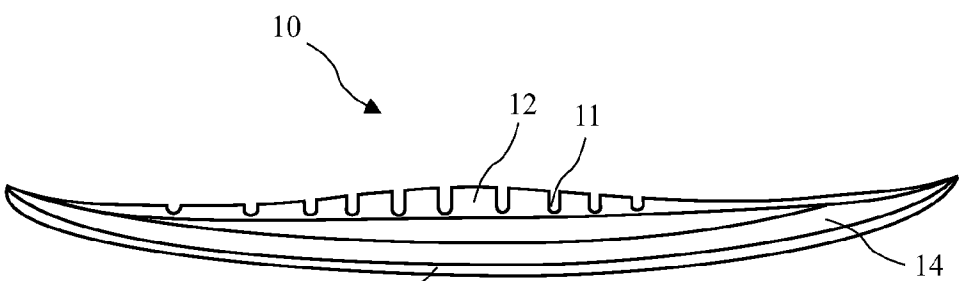
FIG. 1A is a side view of a multi-function boat according to the present invention.
Figure 1C:
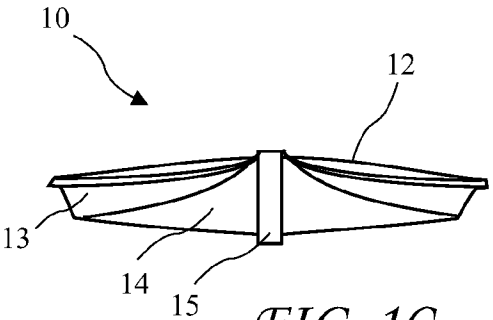
FIG. 1C is a front view of the multi-function boat according to the present invention.

A side view of a multi-function boat 10 according to the present invention is shown in FIG. 1A, a top view of the multi-function boat 10 is shown in FIG. 1B, and a front view of the multi-function boat 10 is shown in FIG. 1C. The boat 10 has a bow 10', a stern 10", a unique banana shaped hull 14, a keel 15, and a flat or slightly convex deck 12. The shape of the hull 14 of the boat 10 provides stability in rough water and large swells. The boat 10 is constructed essentially of foam, fiberglass, and resin, and the fiberglass is volumetrically impregnated approximately ⅔ by the foam and approximately ⅓ by the resin to provide a strong and light weight boat. The boat 10 preferably weighs no more than about 25 pounds dry and can be stored on large boats or ships and used if an evacuation becomes necessary, and may, for example, be constructed primarily of foam for light weight or from a hollow foam core with a resin coating. Such light weight boat 10 is thereby virtually unsinkable and can withstand crashing waves or rocky coastlines with minimal damage.

The boat 10 has no fins or sharp objects projecting from the deck 12 which might cause injury and as a result, riders can easily climb onto the deck 12. The shape of the hull 14 allows the boat 10 to ride large swells, thereby keeping riders safe from cold water and predators until assistance arrives. When the boat 10 tilts to one side, the rider 20 can simply shift his weight to the other side to level the boat 10 to keep the boat right. The deck 12 further preferably includes grooves 11 making the boat 10 more rigid and allowing water to channel off of the boat 10 quickly, keeping the deck 12 of the boat 10 dry to provide greater stability for a rider 20.

The multifunction boat 10 provides a stable, safe floating platform. The boat 10 is preferably approximately twelve inches thick in the center, with approximately eight inches submerged in the water and approximately four inches freeboard above the water. Due to light weight construction, the boat 10 is able to carry up to 500 pounds for a variety of uses. The boat 10 is preferably approximately twelve feet long, approximately four feet wide and the keel 15 is preferably approximately two inches wide and approximately two inches below the hull 14 at the center of the boat 10. The keel 15 provides stability and tends to keep the boat 10 running straight. The sides 13 of the hull 14 are preferably between 25 and 40 degrees from vertical. When water rushes toward one of the sides 13, the side 13 is lifted (just as when the wind lifts a kite), and the water also pushes against the side 13 of the boat 10 which makes the opposite side 13 of the boat 10 rise up as well, so that the entire boat 10 rises at once. The unique banana shape of the boat 10 and is twelve inches high in the center (including two inches of keel height), and one inch in the bow and the stern, making the boat 10 capable of handling large swells, waves and storms.

Figure 2A:
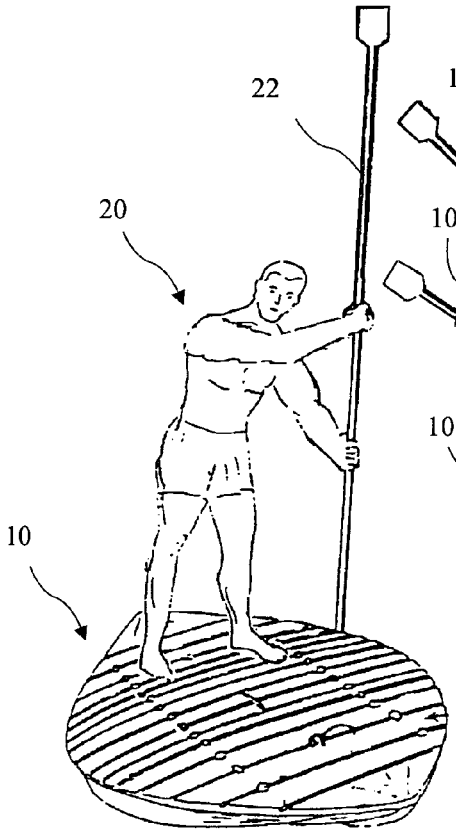
FIG. 2A shows how one person can balance using the paddle to get a full body work-out.

A rider 20 paddling with a two handed paddle 22 is shown in FIG. 2 while standing on deck 14 of the boat 10. This is very different from any other water craft currently on the market. The rider 20 is shown putting the paddle 22 in the water. This enables him to stabilize himself, gaining balance from the surf, because the paddle 22 is approximately 12 feet long, depending on the height of the rider 20. Standing provides the rider 20 with a better view. Similarly to a high wire performer, when the rider 20 paddles in a standing position, he is exercising his balance with the movement of the water. As the rider 20 paddles, he raises his arm on one side and then the other. This movement, executed while standing, enables the rider 20 to exercise his lungs at maximum capacity. With the movement of the boat, he is also exercising his legs. While paddling, he is twisting to the right and the left and dropping downward and stretching upward, thereby getting a total body work out. While standing with a 12 ft paddle 22, the rider 20 is able to reach farther and execute longer strokes.

Figure 3B:
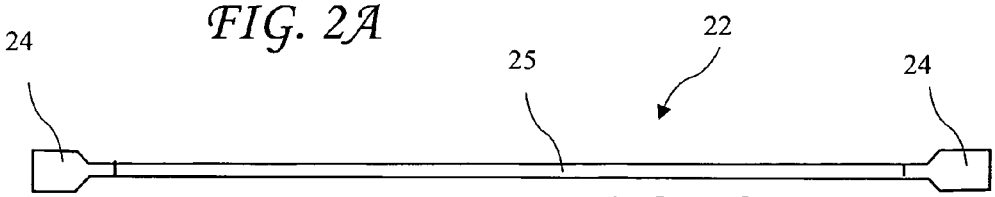
FIG. 3B is a top view of the paddle suitable for use with the multi-function boat.
Figure 3A:
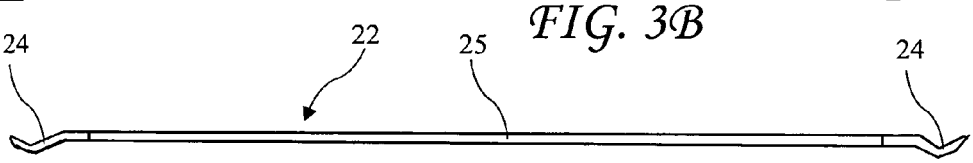
FIG. 3A is a side view of a paddle suitable for use with the multi-function boat.

A more detailed side view of the two handed paddle 22 is shown in FIG. 3A, and a more detailed top view of the two handed paddle 22 is shown in FIG. 3B. The paddle 22 is preferably made of a tubular fiberglass or graphite handle 25, to give sufficient strength and balance. Two spoons 24 at ends of the handle 25 are preferably approximately 10 to 12 inches long by approximately 6 inches wide, and are preferably smaller in comparison to other paddles to allow for long fast movements in paddling.

Figure 2B:
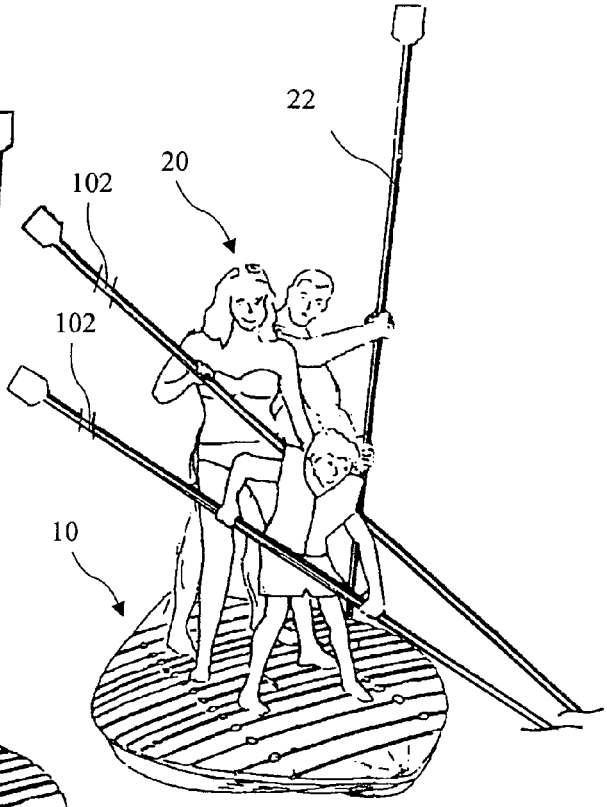
FIG. 2B shows use of the boat as a platform for three people for exercise and coordination.

Three riders 20 are shown in FIG. 2B on the boat 10. The three riders 20 are able to paddle together, making this sport a group or family exercise.

Figure 4:
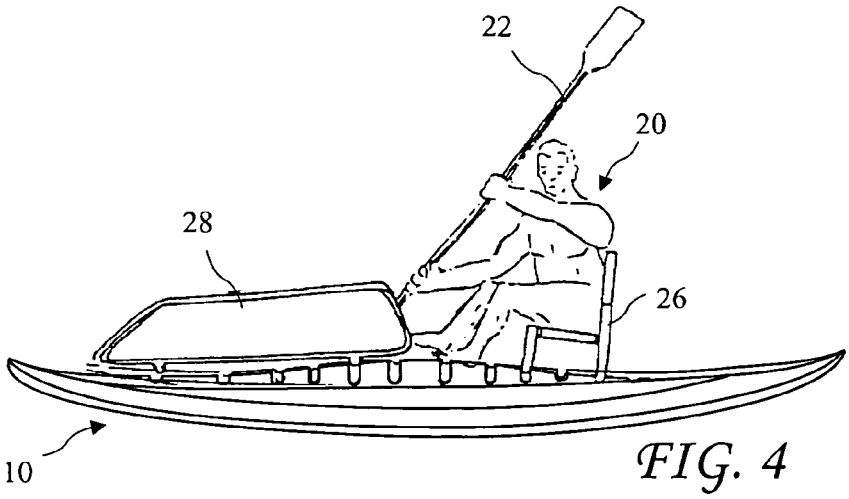
FIG. 4 shows the multi-function boat with utility box attached and being paddled by a single seated rider.

The rider 20 is shown sitting on a chair 26 on the multi-function boat 10 in FIG. 4 with a utility box 28 attached providing additional uses of the boat 10, for example, for fishing and diving. The utility box 28 provides storage and fishing rods 112 can be installed in the recesses 14 (see FIG. 10). The rider 20 may further paddle the boat 10 from a seated position like a kayak. Unlike a kayak, however, the rider 20 is above the water and not as susceptible to being drenched by cold waves. The hull 14 design further provides stability to allow the rider 20 to stand up and use the utility box 28.

Figure 5:
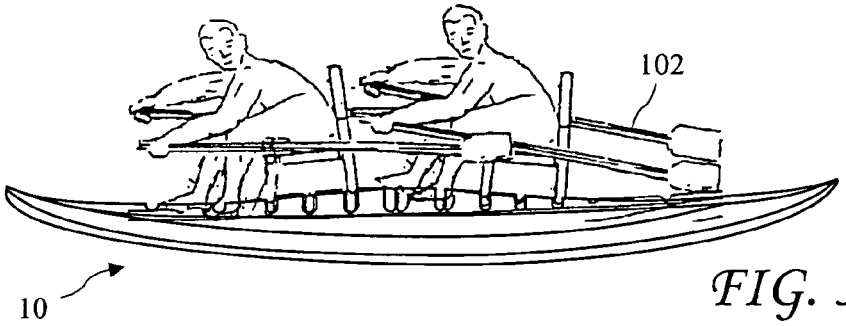
FIG. 5 shows the versatility of the multi-function boat with chairs and rowing holders for two riders.
Figure 6:
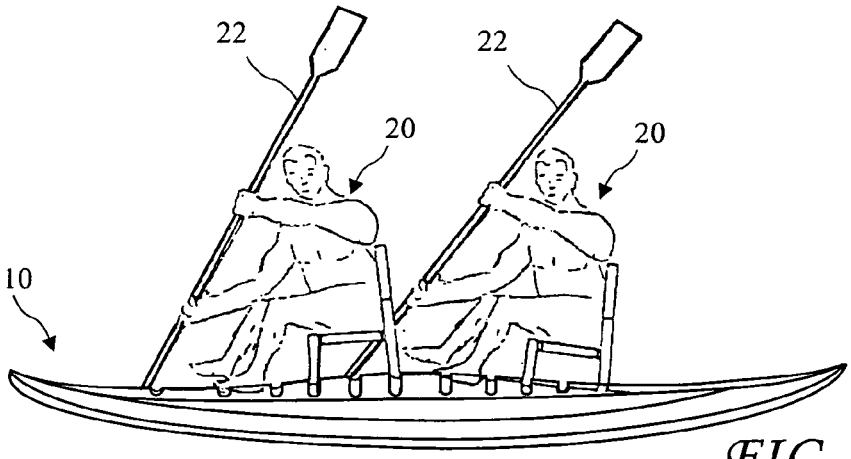
FIG. 6 shows the multi-function boat in use with paddles and chairs for two riders.

The versatility of the boat 10 is further illustrated in FIG. 5 showing the boat 10 used for rowing as a platform with two chairs 26 and two riders 20 are shown sitting on the chairs and paddling in FIG. 6. The riders 20 are also able to stand and paddle or sit on the chair 26 when he becomes tired. The rider 20 is further able to create his own customized attachments that best suit his needs.

Figure 7:
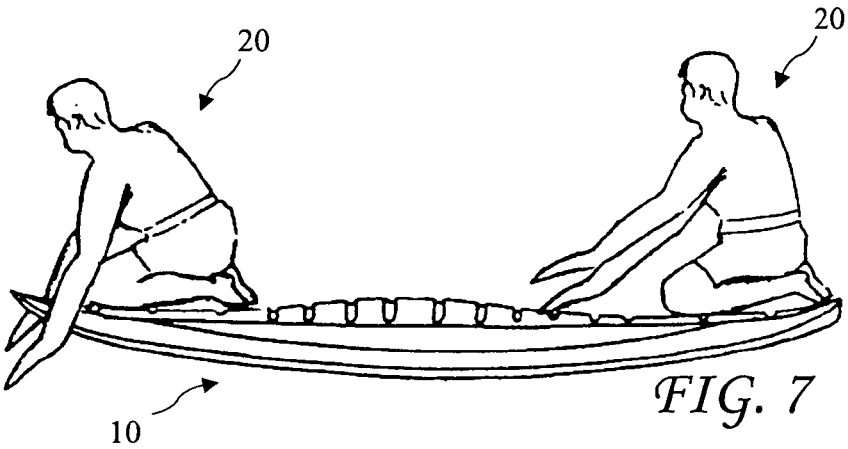
FIG. 7 shows two riders paddling the multi-function boat by hand.
Figure 8:
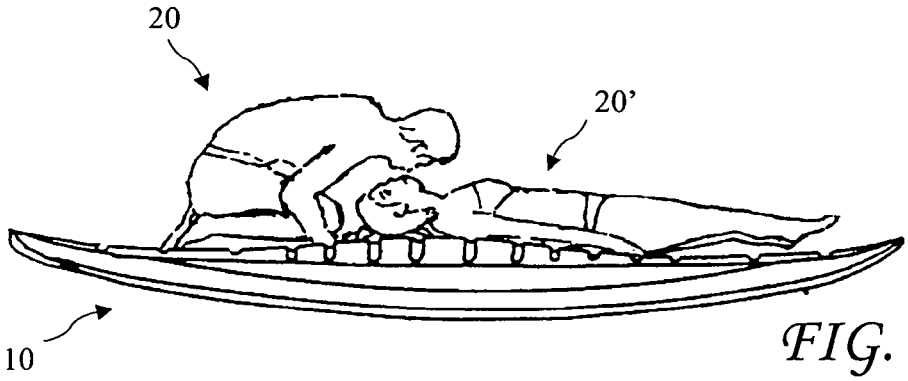
FIG. 8 shows use of the multi-function boat to administer CPR in an emergency situation.
Figure 9:
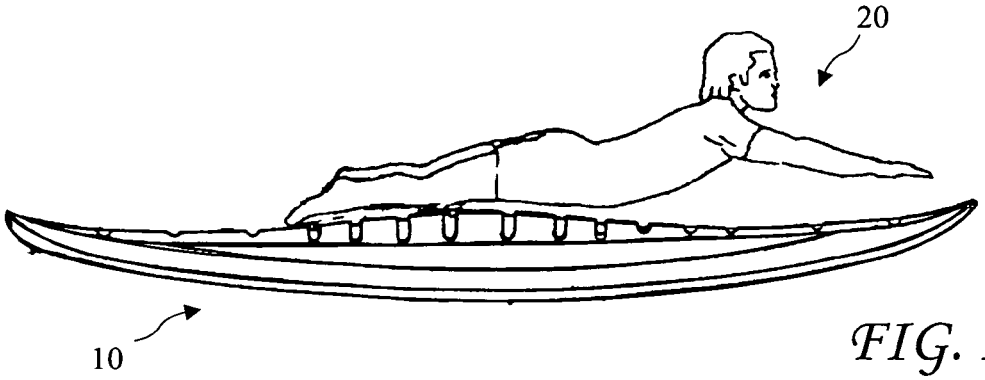
FIG. 9 shows one rider paddling the multi-function boat by hand.

Two riders 20 are shown kneeling on the boat 10 and paddling by hand in FIG. 7, the boat 10 is shown as a platform for administering CPR or emergency help to a drowning victim 20' in FIG. 8, and one rider 20 is shown lying on his stomach on the boat 10 and paddling by hand in FIG. 9. The rider 20 is able to hand one end of the twelve foot long paddle 22 to the drowning victim and bring him toward the boat 10. Further, the rounded shape of the hull 14 of the boat 10 allows the rider 20 to walk forward and sink the bow or the stern of the boat 10 making it easier to slide a victim from the water onto the boat 10. Similarly, objects may be retrieved from the water using the paddle 22. Due to the features described above, this invention is particularly useful for ocean, lake, flood, and ice rescue.

Figure 10:
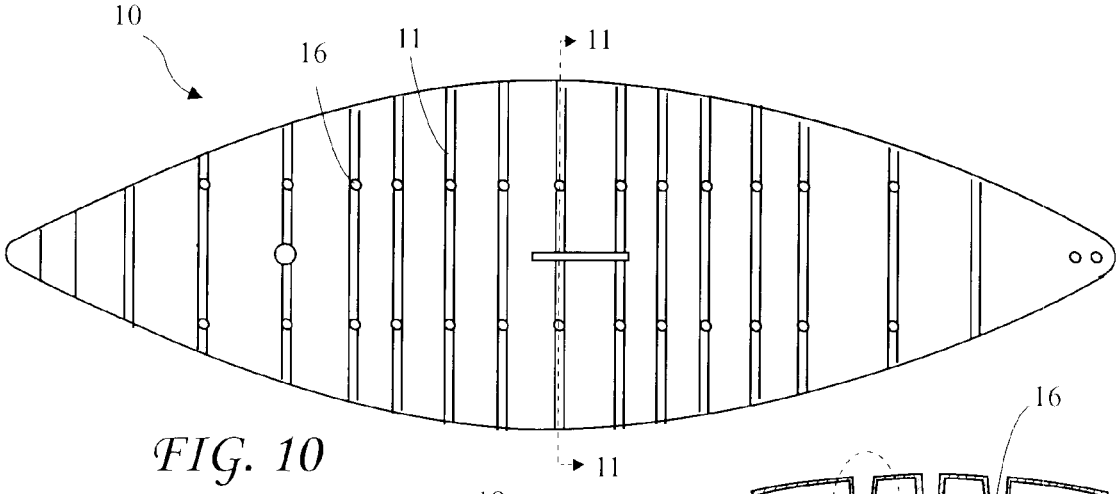
FIG. 10 shows a top view of the multi-function boat including recesses for attaching accessories.

A top view of the boat 10 showing accessory recesses 16 is shown in FIG. 10. The deck of the boat 10 has grooves 11 for allowing water to run off the deck easier, and recesses 16 may be aligned with the grooves 11 for accessory inserts 16.

Figure 11:
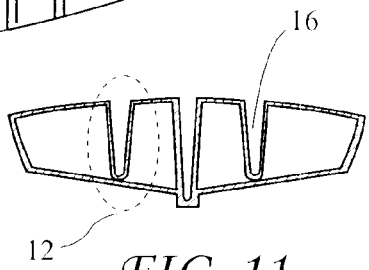
FIG. 11 shows a cross-sectional view of the middle of the boat taken along line 11-11 of FIG. 10 showing.

A cross-sectional view of the boat 10 taken along line 11-11 of FIG. 10 is shown in FIG. 11, showing details of the recesses 16.

Figure 12:
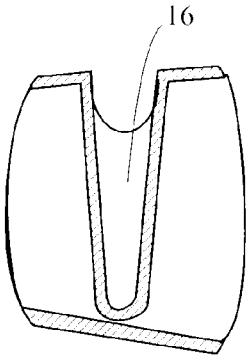
FIG. 12 shows detail 12 of FIG. 11.
Figure 12A:
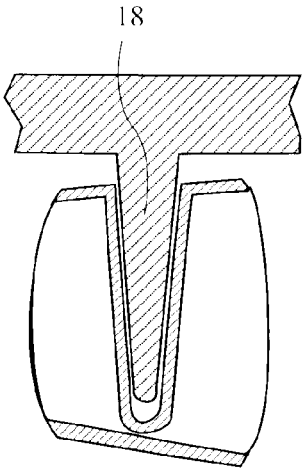
FIG. 12A shows details 12 of FIG. 11 with a large accessory attached to the boat.
Figure 12B:
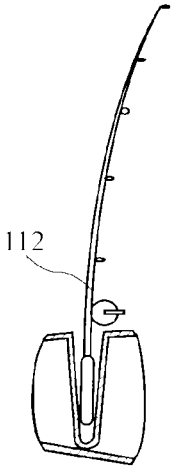
FIG. 12B shows details 12 of FIG. 11 with a fishing pole attached to the boat.

The detail 12 of FIG. 11 of the recess 16 is shown in FIG. 12 and the detail 12 of FIG. 11 showing an accessory inserts 18 inside the recess 16 is shown in FIG. 12A and with a fishing pole 112 inserted into the recess 16 in FIG. 12B. The recesses 16 may thus be used to attach a variety of accessories having inserts 18 or, like a fishing pole 112, having a handle or other feature, insertible into the recess 16.

Figure 13:
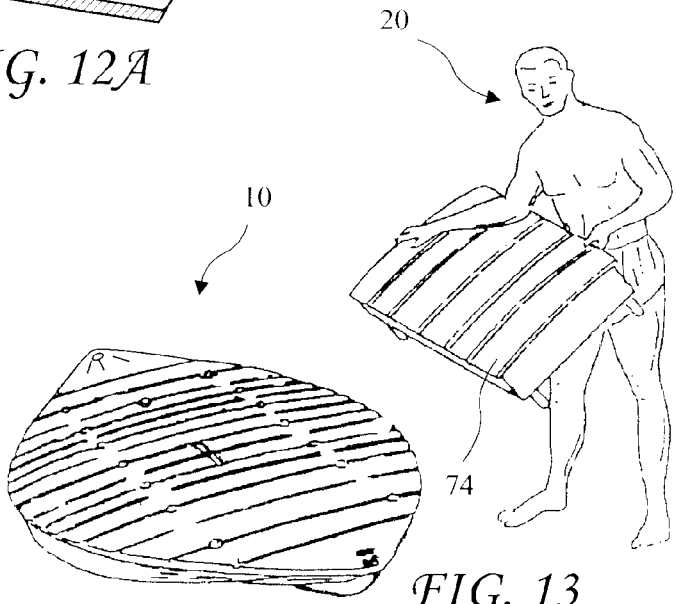
FIG. 13 shows a perspective top view of the boat with a rider placing a utility box on the boat.

A top perspective view of the boat 10 and a rider 20 preparing to install an accessory 74 onto the boat 10 is shown in FIG. 13.

A top perspective view of the boat 10 with wheels 32 attached for easy transporting is shown in FIG. 14 and attachment of wheels 32 using bungee cords 34 stretched on top of the boat 10 and inserts 18 inserted into accessory recesses 16 in the boat 10 is shown in FIG. 15. Using the accessory recesses 16 to attached the wheels 106 resists fore or aft slipping and provides a secure attachment of the wheels 32. A handle 20 on the boat 10 is then used to move the boat 10 to or from the water. Once the wheels 32 are pulled off of the boat 10, the boat is smooth and free of any external object that may cause injury.

The boat 10 is shown strapped to the top of a car 108 in FIG. 16 for easy long distance transporting. The aerodynamic shape of the boat 10 facilitates such transporting on the top of a vehicle.

Figure 17:
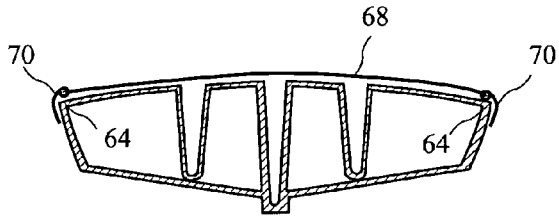
FIG. 17 shows an accessory strap attached to the boat.

A side view of the boat 10 is shown in FIG. 17 showing an accessory strap (e.g., a rope, strap, or bungee) 68 attached to the boat 10 and passing over the deck 12. Hooks 70 at each end of the strap 68 hook over lips 64 on edges of the deck 12. The strap 68 may include a Velcro® fastener or a short rope, attached to the strap 68 to hold the paddle 22 to the boat 10. The strap 68 may thus restrain the paddle 22, a utility box, a pontoon, a sailing saddle and other article to the boat 10.

Figure 18:
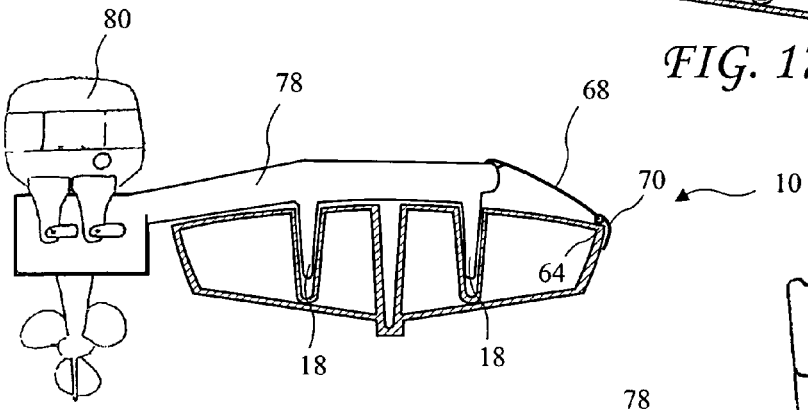
FIG. 18 shows motor mount and motor fitted to the boat.
Figure 19:
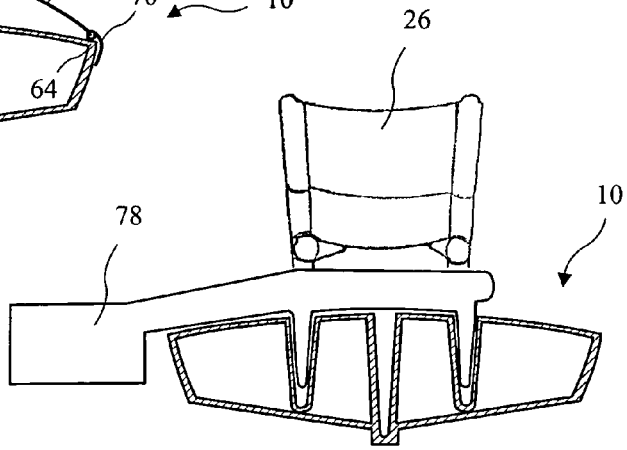
FIG. 19 shows a chair and motor mount fitted to the boat.
Figure 20:
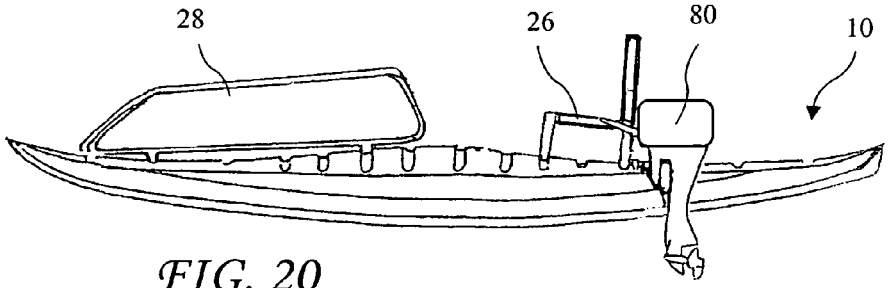
FIG. 20 shows side view of motor mount, motor, chair and utility box inserted onto the boat.

A cross-sectional view of the boat 10 with an outboard motor 80 attached to the boat 10 by a motor mount 78 is shown in FIG. 18, the motor mount 78 is shown fitted on the boat 10 without the motor 80 in FIG. 19, and a side view of the boat 10 with the motor 80 is shown in FIG. 20. The motor mount 78 includes inserts 18 inserted into the recesses 16 and the strap 68 hooked over the lip 64 to buckle firmly to the boat 10.

Figure 21C:
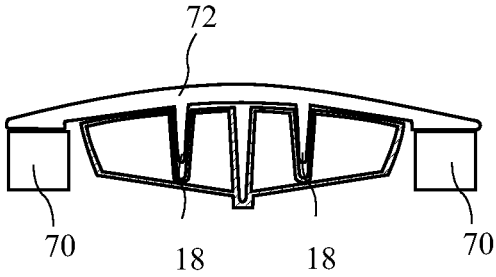
FIG. 21C shows a cross-sectional view of the installed pontoon accessory which gives the boat stability.
Figure 21B:
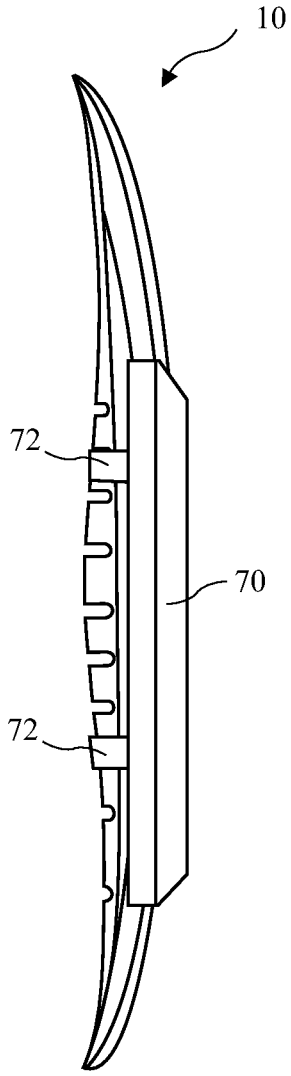
FIG. 21B shows a side view of the installed pontoon accessory which gives the boat stability.
Figure 21A:
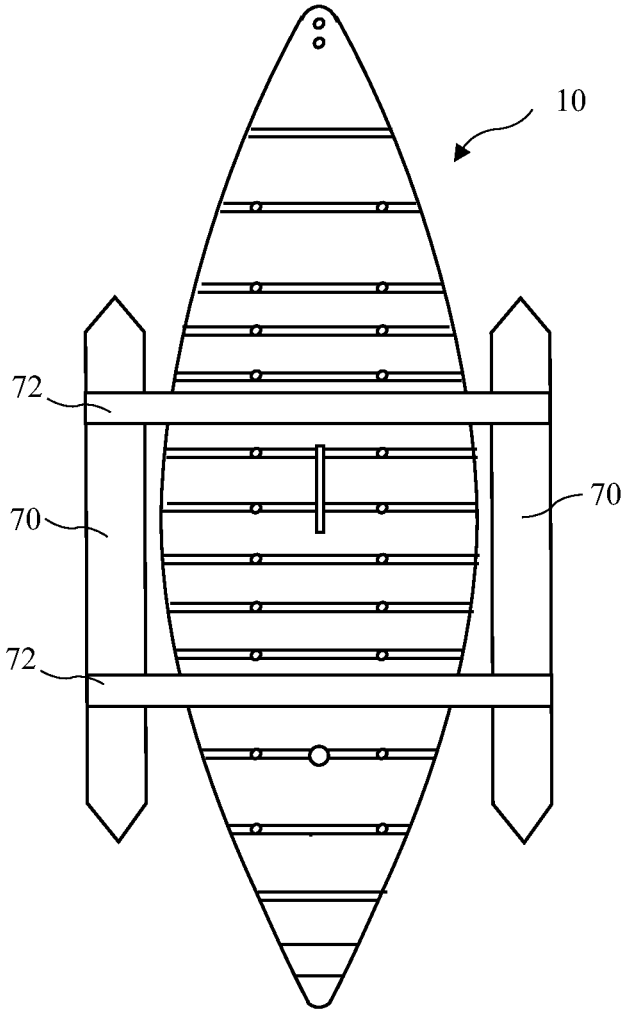
FIG. 21A shows a top view of an installed pontoon accessory which gives the boat stability.

A top view of pontoons 70 fitted on the boat 10 is shown in FIG. 21A, a side view of the pontoon 70 fitted on the boat 10 is shown in FIG. 21B, and a cross-sectional view of the pontoon 70 fitted on the boat 10 is shown in FIG. 21C. Booms 72 reach across the deck 12 and are held in position by inserts 18 inserted into the recesses 16 in the deck 12. Straps 68 connected to the lip 64 shown in FIG. 17 are preferably used to further hold the boom 72 in place. The pontoons 70 provides more stability and the booms 72 may be laterally extendable if desired for greater stability.

Figure 22C:
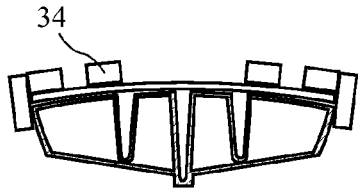
FIG. 22C shows a cross-sectional view of the boat rigged for sailing.
Figure 22B:
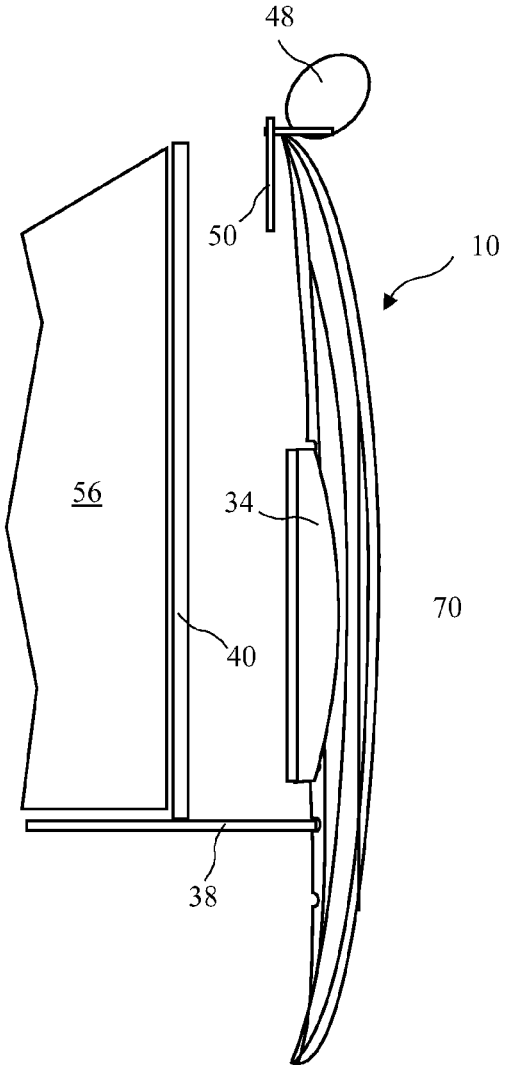
FIG. 22B shows a side view of the boat rigged for sailing.
Figure 22A:
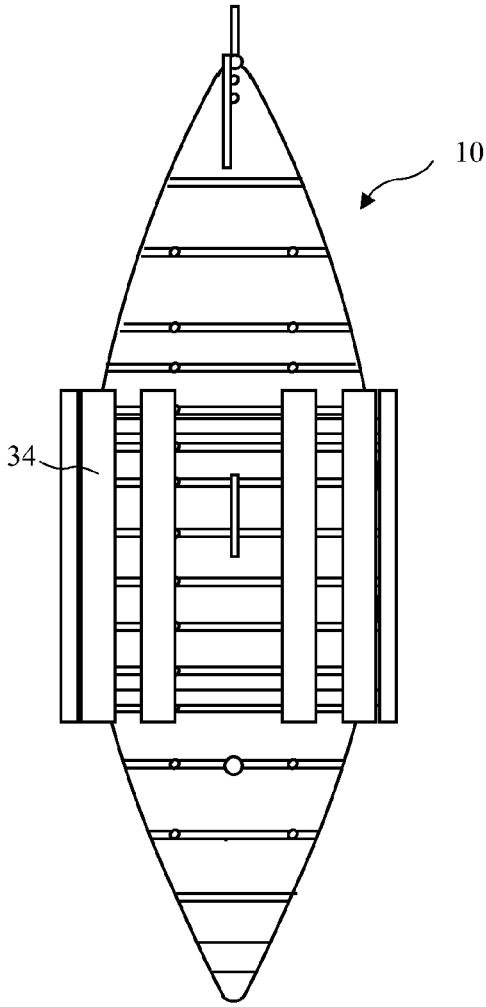
FIG. 22A shows a top view of the boat rigged for sailing.

A top view of the boat 10 rigged for sailing is shown in FIG. 22A, a side view of the boat 10 rigged for sailing is shown in FIG. 22B, and a cross-sectional view of the boat 10 rigged for sailing is shown in FIG. 22C. The boat 10 is shown rigged for sailing and includes a mast 38, boom 40, sail 56, rudder 48, and tiller 50. The boat 10 rigged for sailing further includes a sailing saddle 34 used for leverage while sailing demonstrating how the sailing saddle 34 resides on the deck 12 and includes inserts 18 inserted into the recesses 16 for holding the position of the saddle 34 on the deck 12, and further may include straps having hooks engaging the lip 64 to stay secure on the deck 12. The mast 38 is shown fitted into the boat 10 into one of the recesses 16 and the rudder 48 and tiller 50 may be fitted on the boat 10, for example, with two plastic bolts and wing nuts. The rudder 48 is preferably hinges to lift when it touches the ground. The mast and rudder are removable from the boat 10, leaving no fins or hooks or any sharp projections which may cause injury.

Figures 23, 24, 25:
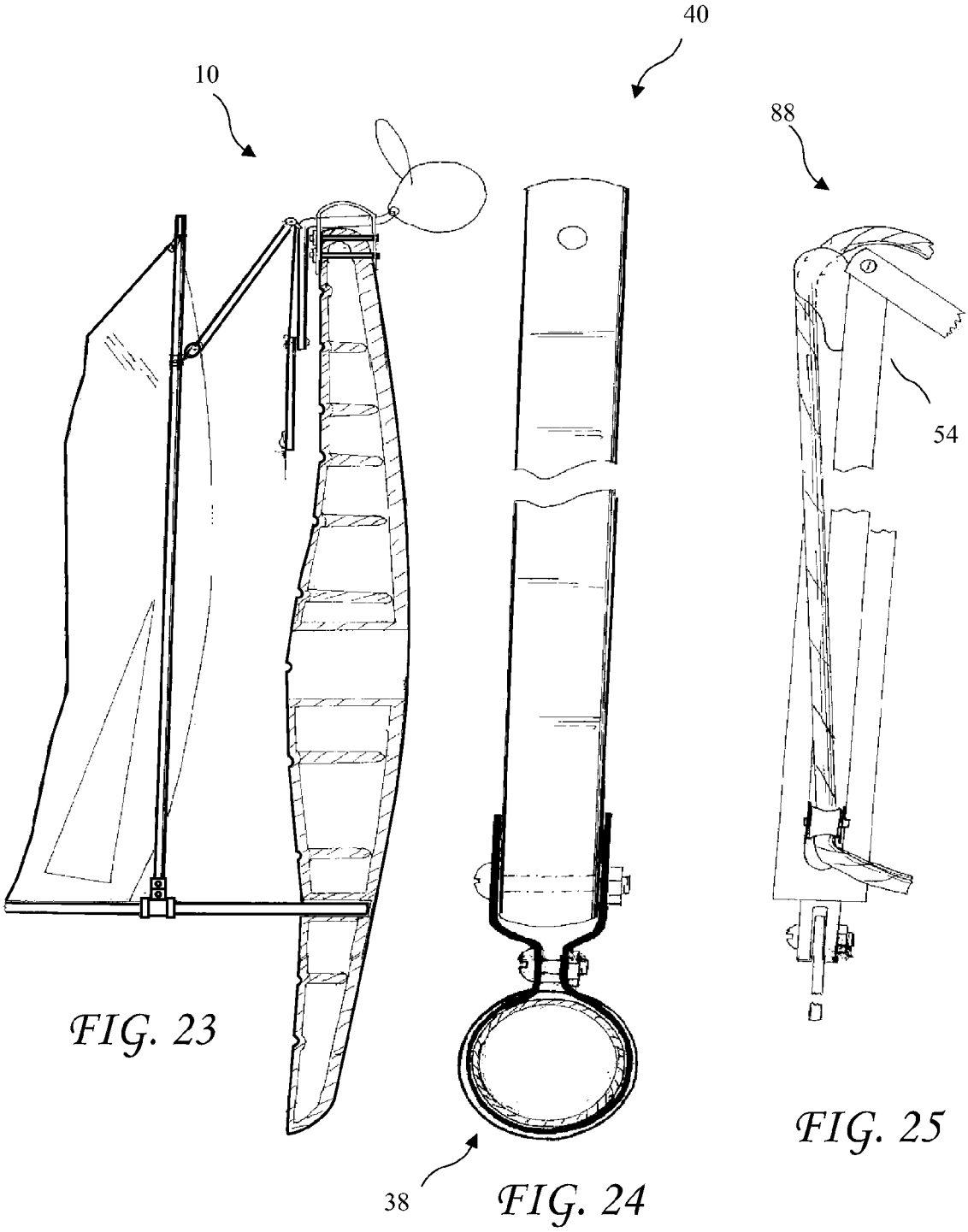
FIG. 23 shows a cross-sectional view of the boat rigged for sailing.
FIG. 24 shows a goose neck connected to and working in conjunction with a mast and a boom.
FIG. 25 shows a top view of rudder and rope cleat.
Figure 27:
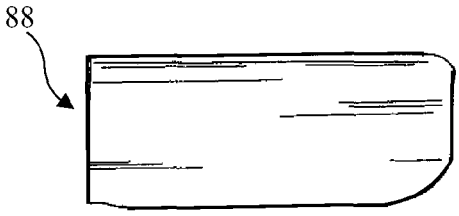
FIG. 27 shows a bottom view of cleat.
Figure 30:
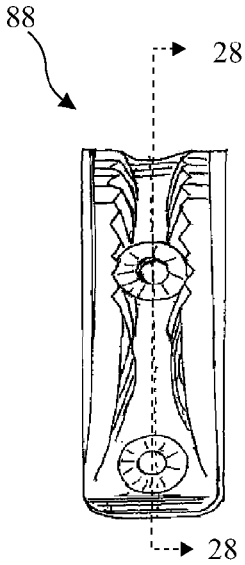
FIG. 30 shows a top view of the cleat.
Figure 28:
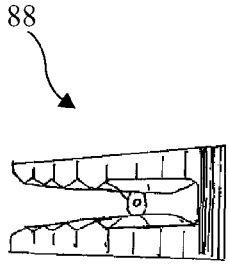
FIG. 28 shows an end view of the cleat.
Figure 31:
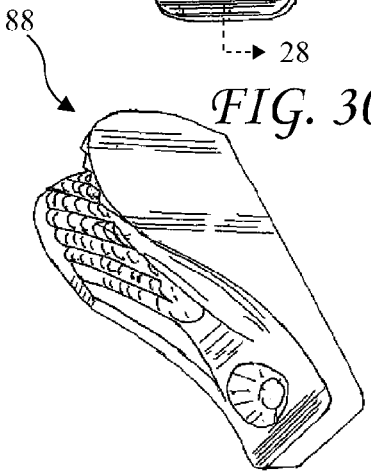
FIG. 31 shows a top perspective view of the cleat at a 45 degree angle.
Figure 29:
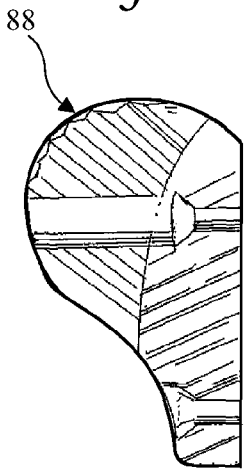
FIG. 29 shows cross-sectional side view of cleat taken along line 29-29 of FIG. 30.
Figure 26:
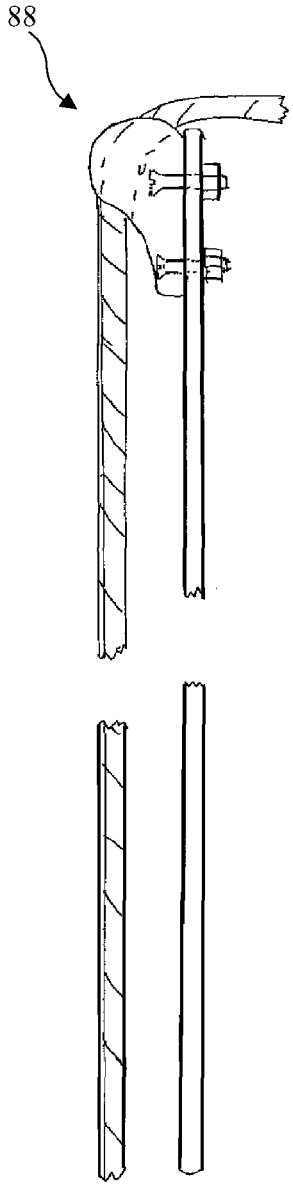
FIG. 26 shows the improved cleat with rounded edges which greatly facilitates cleating and releasing the rope.

A side view of the boat 10 rigged for sailing is shown in FIG. 23 and a detailed top view of the boom 40 is shown in FIG. 24.

A cleat 88 according to the present invention at the end of a rudder handle 54 is shown in FIGS. 25-31. The round shape of the cleat 88 is unique, making it easier to cleat a rope. All that is needed is to bend the rope around the cleat and it will pull it in firmly. With other cleats, the operator has to push in the ropes to cleat. When sailing, an individual has only two arms to maneuver and this invention makes it faster and easier for corners.

The boat 10 may be constructed of foam with a plastic coating. The boat preferably weighs approximately 25 pounds, and may be thrown off a larger boat or dock for rescue. A drowning person can easily climb onto the boat and stay safe from cold water and predators on a stable platform. Even a dog is able to climb on the boat. The boat may thus be modified for many purposes.

A preferred embodiment of the multifunction boat 10 is a rescue boat 10*a*. The rescue boat 10*a* weighs approximately 25 pounds dry and is preferably approximately 8 feet in length. The rescue boat 10*a* is preferably constructed as one solid piece with no seams thus having no weak points. In addition, the rescue boat 10*a* is preferably constructed from a hollow foam core with an epoxy coating. The rescue boat 10*a* is designed so that it can withstand crashing waves or rocky coastlines with minimal damage. Because of its light weight, the rescue boat 10*a* may be stored on large boats or ships and used if an evacuation becomes necessary, and can be thrown into the water by one person. Evacuated passengers can easily climb onto the rescue boat 10*a* which has no fins or sharp objects which can cause injury. The rescue boat 10*a* is able to ride large swells, thereby keeping riders safe from cold water and sharks until assistance arrive.

Figure 32:
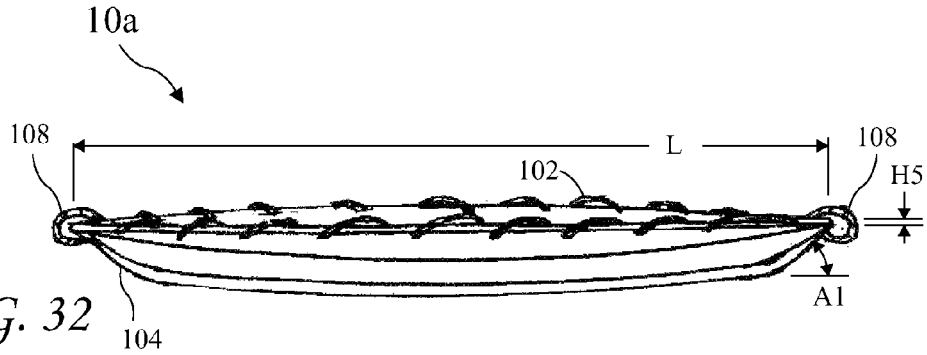
FIG. 32 shows a side view of a second embodiment of the boat comprising a rescue boat according to the present invention with a looping boarding rope around the edge of the deck.
Figure 33:
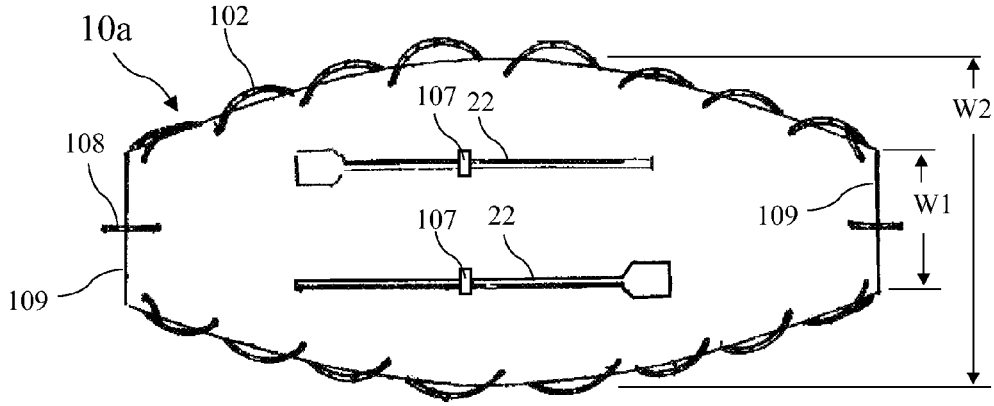
FIG. 33 shows a top view of the rescue boat according to the present invention.
Figure 34:
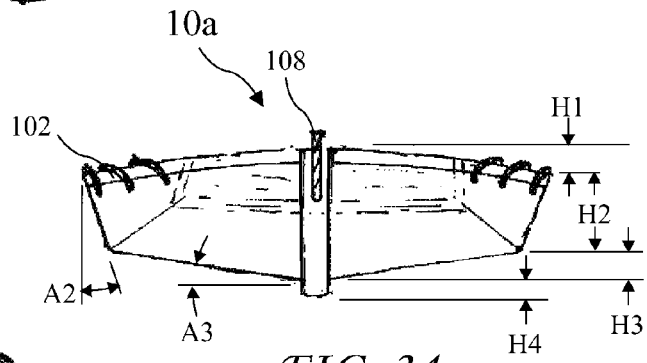
FIG. 34 shows a front (or rear) view of the rescue boat according to the present invention.
Figure 35:
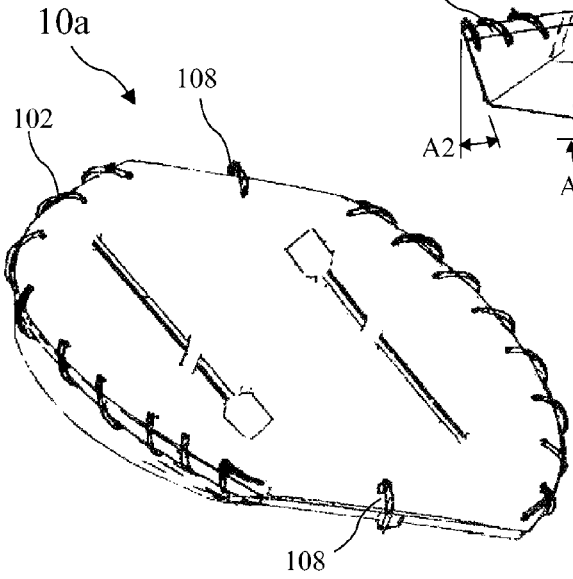
FIG. 35 shows a top perspective view of the rescue boat according to the present invention.

A side view of the rescue boat 10*a* according to the present invention is shown in FIG. 32, a top view of the rescue boat 10*a* is shown in FIG. 33, a front (or rear) view of the rescue boat 10*a* is shown in FIG. 34, and a top perspective view of the rescue boat 10*a* is shown in FIG. 35. The rescue boat 10*a* includes a looping boarding rope 102 along each side, attached by passing through holes along the edge of the rescue boat 10*a*. The boarding rope allows a swimmer to grasp and pull themself onto the rescue boat 10*a*. The rescue boat 10*a* is sufficiently wide to resist turning over when a swimmer attempts to climb aboard. Additionally, the rescue boat 10*a* has a rounded hull bottom allowing the rescue boat 10*a* to roll somewhat, to make climbing aboard easier for a tired swimmer. The cooperation of the width and the rounded hull bottom provide significant benefits in a rescue scenario.

Preferably, the boarding rope 102 is stitched along each side, about 2 inches from the edge of the rescue boat 10*a*. The boarding rope 102 is inserted through holes on each side of the rescue boat 10*a*. The holes are lines with a plastic tube which is level with the top and bottom of the holes to prevent foam from pulling or tugging at the boarding rope 102. Handles 108 are provided at the blunt bow and stern 109 of the rescue boat 10*a* for carrying or otherwise moving the rescue boat 10*a*. The handles 108 are preferably attached through holes through the rescue boat 10*a* about 4 inches in from the bow and stern similar to the attachment of the boarding rope 102. Oars (or paddles) 106 reside in oar recesses 116 (see FIG. 39) and are held in place by straps 107, which are preferably Velcro® material. The oars 106 are thus easily extracted for use in an emergency. The oars are preferably about 6 feet long and can be used like a canoe paddle or two oars may be connected together to form a twelve foot paddle.

Figure 36:
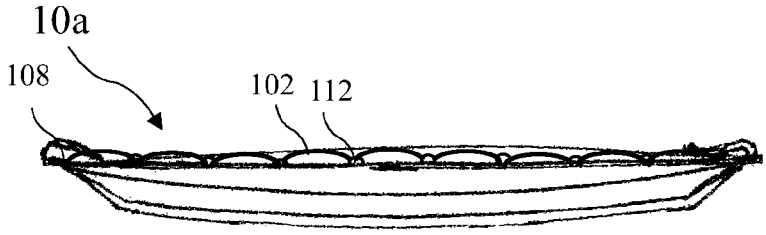
FIG. 36 shows a side view of the rescue boat according to the present invention having bow and stern boarding ropes.
Figure 37:
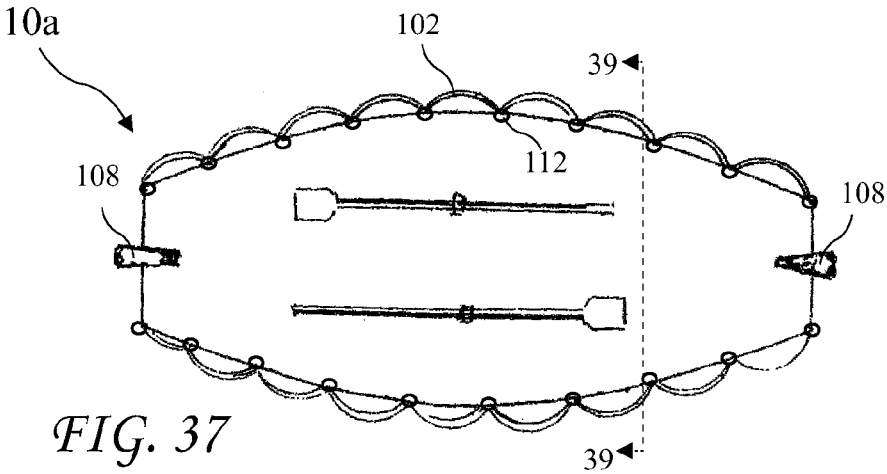
FIG. 37 shows a top view of the rescue boat according to the present invention having bow and stern boarding ropes.
Figure 38:
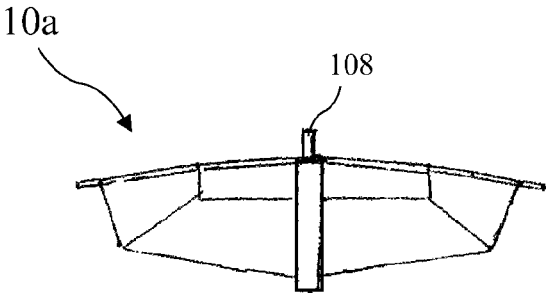
FIG. 38 shows a front (or rear) view of the rescue boat according to the present invention.
Figure 39:
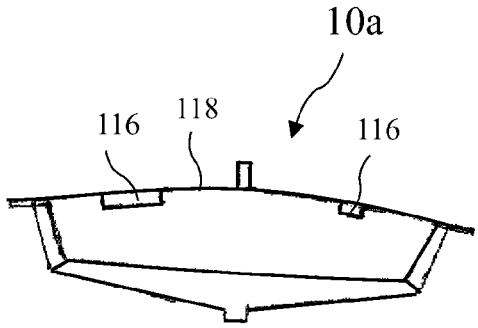
FIG. 39 shows a cross-sectional view of the second embodiment of the rescue boat according to the present invention taken along line 39-39 of FIG. 37.
Figure 40:
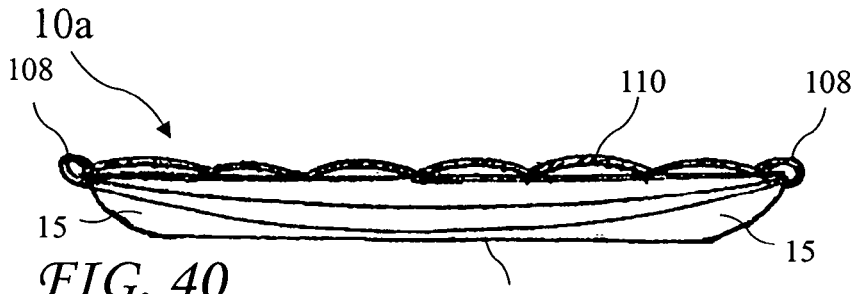
FIG. 40 shows a side view of a third embodiment of the rescue boat according to the present invention comprising a second rescue boat having the boarding rope moved inboard.

A side view of the rescue boat 10*a* showing bow and stern boarding ropes 108 and the boarding rope 102 attached by hardware 112 is shown in FIG. 36, a top view of the rescue boat 10*a* having the boarding rope 102 attached by hardware 112 is shown in FIG. 37, a front (or rear) view of the rescue boat 10*a* having the boarding rope 102 attached by hardware 112 is shown in FIG. 38, and a cross-sectional view of the rescue boat 10*a* showing recesses for oars is shown in FIG. 39. The hardware 112 may be any hardware mounted to the rescue boat 10*a* to facilitate attaching the boarding rope 102 for example, a toggle bolt inserted into the rescue boat 10*a*.

The deck 12 of the rescue boat 10*a* is preferably convex so that any water which passes over the rescue boat 10*a* water immediately runs off the rescue boat 10*a*. The rescue boat 10*a* has a length L, bow and stern widths W1, overall width W2, bow and stern edge tapers A1, side edge tapers A2, hull slope A3, deck height H1, wall height H2, bottom height H3, and keel height H4. The bow and stern ends of the rescue boat 10*a* are blunt ends with a height H5 to reduce or prevent both injury to a swimmer who might encounter the boat and to reduce or eliminate damage to the boat from hitting hard objects. The dimensions are preferably approximately:

L is between 6 and 10 feet and is preferably about 8 feet;

W1 is between 1 and 3 feet and is preferably about 2 feet;

W2 is between 3 and 6 feet and is preferably about 4.5 feet;

H1 is between ¼ and 2 inches and is preferably about 1 inch;

H2 is between 6 and 10 inches and is preferably about 8 inches;

H3 is between 1 and 3 inches and is preferably about 2 inch;

H4 is between 1 and 3 inches and is preferably about 2 inch;

H5 is between 1 and 2 inches and is preferably about 1 inch;

A1 is between 30 and 50 degree and is preferably about 40 degrees;

A2 is between 25 and 40 degree and is preferably about 30 degrees; and

A3 is between 5 and 15 degree.

Another embodiment of the rescue boat 10*a* is shown in FIGS. 40-43. The rescue boat 10*a* is similar to the rescue boat 10*a* but has a second boarding rope 110 moved inboard to allow easier grasping by an individual in the water, and more secure attachment to the boat 10*a*. The boarding rope 110 is preferably secured to the rescue boat 10*a* by running the boarding rope 110 through tubes buried inside the rescue boat 10*a*. The keel 15 of the rescue boat 10*a* has an approximately horizontal base 15*a* for most the length of the keel 15, and separates vertically from the hull 14 at the bow and stern of the boat 10*a*, providing fin like structures to add stability to the boat 10*a*. The horizontal base 15*a* extends for 80 percent of the length of the rescue boat 10*a*.

Figure 41:
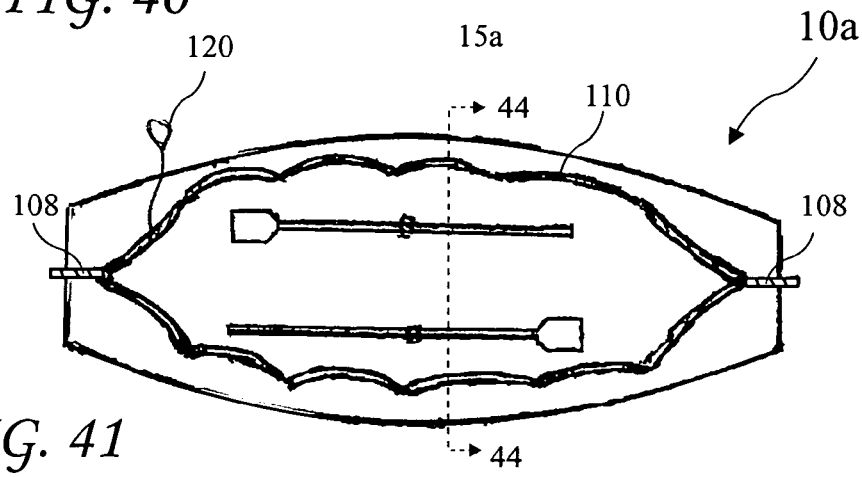
FIG. 41 shows a top view of the third rescue boat according to the present invention.
Figure 42:
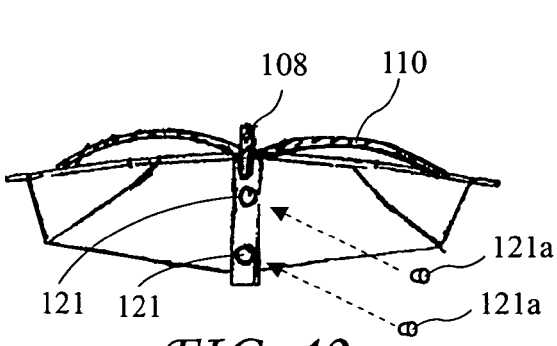
FIG. 42 shows a bow or stern view of the third rescue boat according to the present invention.
Figure 44:
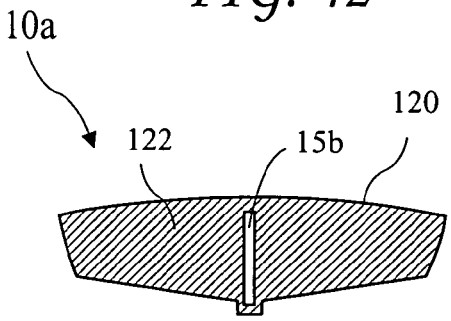
FIG. 44 shows a cross-sectional view of the third rescue boat according to the present invention taken along line 44-44 of FIG. 41.
Figure 43:
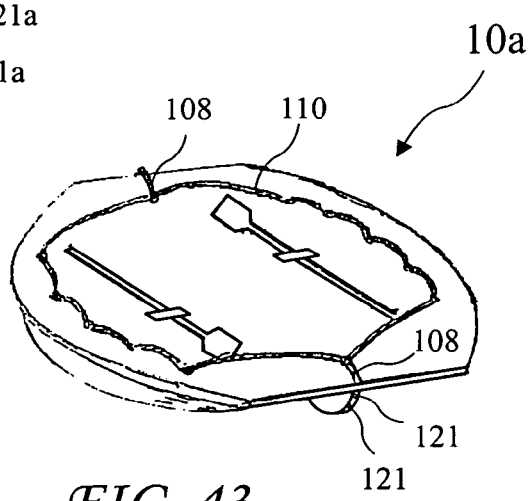
FIG. 43 shows a top perspective view of the third rescue boat according to the present invention.

A cross-sectional view of the boat 10*a* taken along line 44-44 of FIG. 41 is shown in FIG. 44 showing a fiberglass exterior 120, a foam filled interior 122, and a hollow keel 15*b*. Vertically spaced apart passages 121 allow water to flow into the hollow keel 15*a* when the boat is in the water for stability, and allow the water to drain from the hollow keel 15*a* when the boat 10*a* is removed from the water to provide light weight. Plugs 121*a* are provided to block the passages 121 to prevent water from entering the hollow keel, to retain water in the hollow keel, or to control the amount of water in the hollow keel. The passages 121 are preferably only at the rear of the boat 10*a*.

Figure 45:
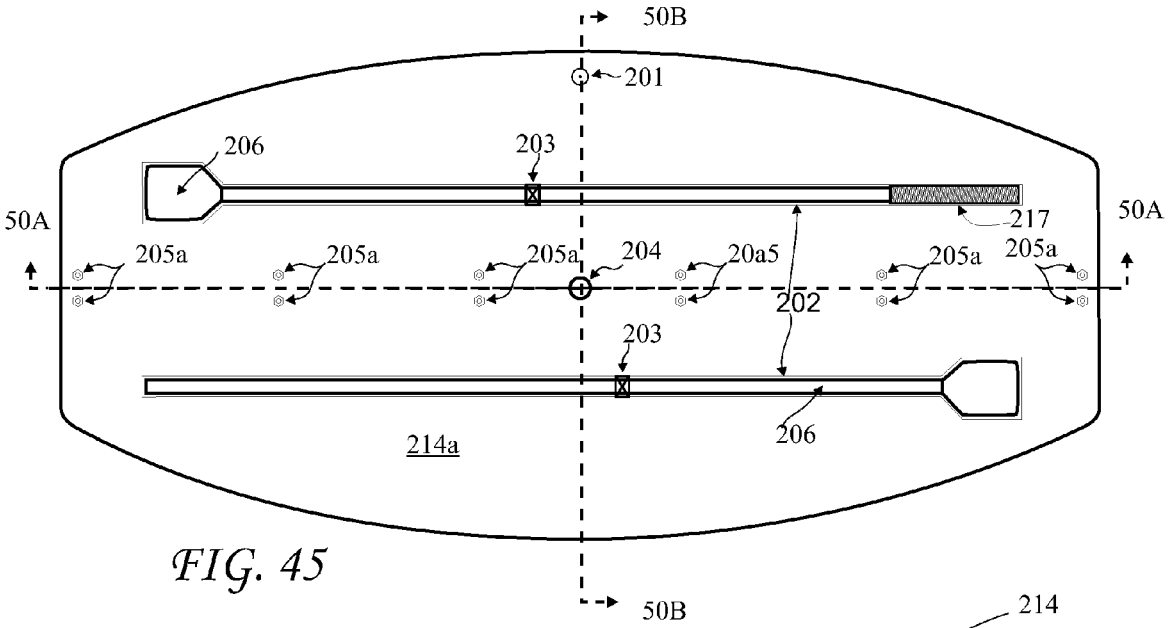
FIG. 45 shows a top view of a fourth embodiment of the rescue boat according to the present invention.
Figure 46:
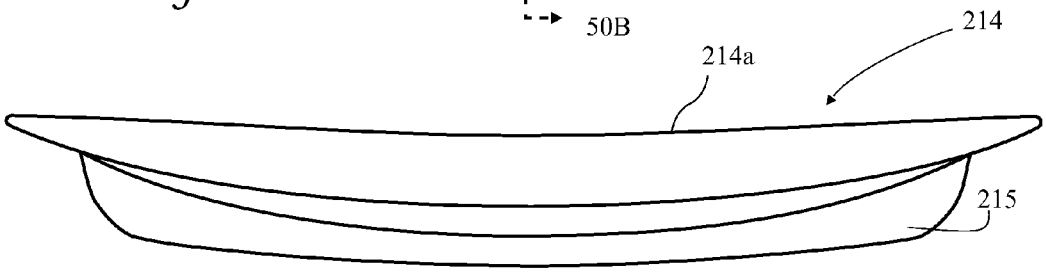
FIG. 46 shows a side view of the fourth embodiment of the rescue boat according to the present invention.
Figure 47:
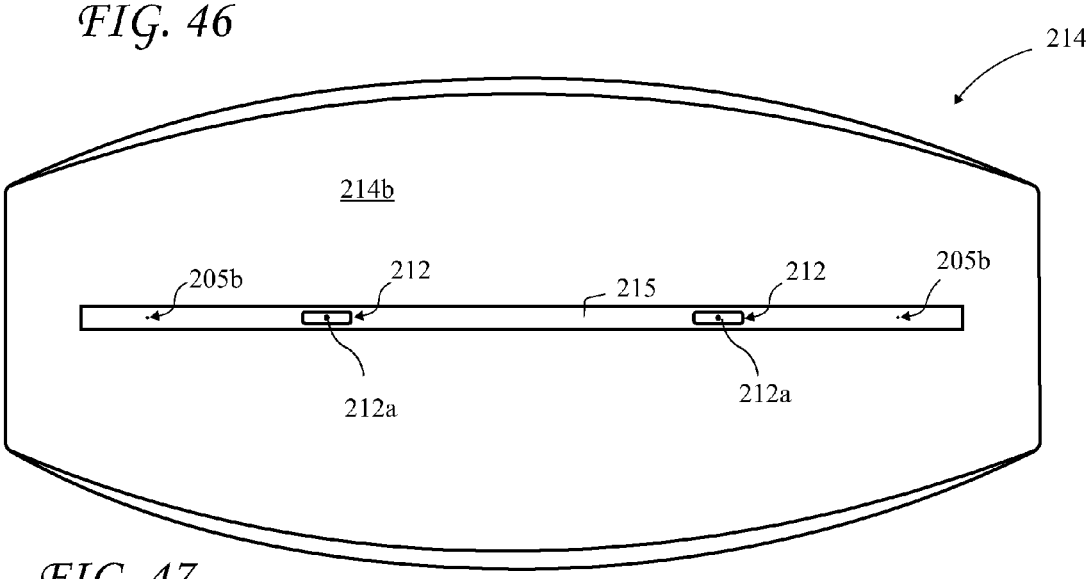
FIG. 47 shows a bottom view of the fourth embodiment of the rescue boat according to the present invention.

FIG. 45 shows a top view of a fourth embodiment of the rescue boat 214 according to the present invention, FIG. 46 shows a side view of the rescue boat 214, and FIG. 47 shows a bottom view of the rescue boat 214. The rescue boat 214 includes a vertical passage 204 through the boat and connecting to a ballast volume 215*a* (see FIG. 50A) in the keel 215. An air valves 201 allows a user to fill the rescue boat 214 with low pressure air to add rigidity to the rescue boat 214. The deck 214*a* is slightly concave and water collected in the concave deck 214*a* is free to run through the rescue boat 214 into the ballast volume 215*a* (see FIG. 50B), and air trapped in the ballast volume 215*a* is free to escape through the vertical passage 204. Concave indentations 212 along the bottom of the keel 215 include holes 212*a* allowing water to enter the ballast volume 215*a* when the rescue boat 214 is in the water.

Figure 48B:
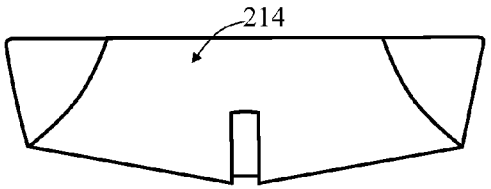
FIG. 48B shows a bow view of the fourth embodiment of the rescue boat with the removable keel detached according to the present invention.
Figure 48A:
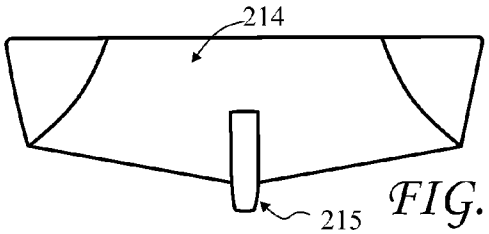
FIG. 48A shows a bow view of the fourth embodiment of the rescue boat with a removable keel attached according to the present invention.

Paddle inserts 202 allow the paddles 206 to be taken apart and attached to the boat for easy storage and transport and hook and loop fasteners 203 secure the paddles into the paddle inserts 202. The paddles 206 may include a paddle sleeve 217 allowing tow paddles 206 to be connected to create a longer paddle. Threaded holes 205*a* are provided on the deck 241*a* to facilitate attachment of various accessories. Additional threaded holes 205*b* are provided on the bottom 214*a* of the rescue boat 214 for attachment of a removable hollow keel 215. The threaded holes 205*a* and 205*b* may be formed by molding nuts, inserts, or the like into the rescue boat 214, and preferably stainless steel nuts or inserts are used to form the threaded holes 205*b*. The hollow keel 215 includes passages allowing FIG. 48A shows a bow view of the rescue boat 214 with the removable keel 215 attached and FIG. 48B shows a bow view of the rescue boat 214 with the removable keel 215 detached.

Figure 49:
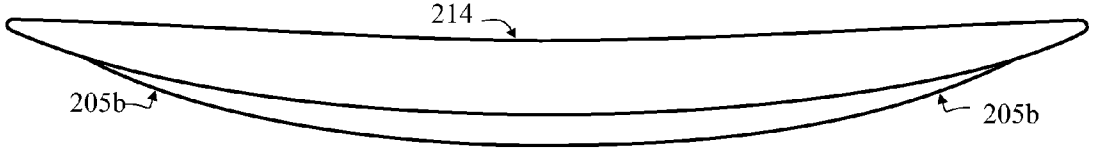
FIG. 49 shows a side view of the fourth embodiment of the rescue boat showing attachment points for the removable keel according to the present invention.

FIG. 49 shows a side view of the rescue boat 214 showing the threaded holes 205*b* for attaching the removable keel 215.

Figure 50B:
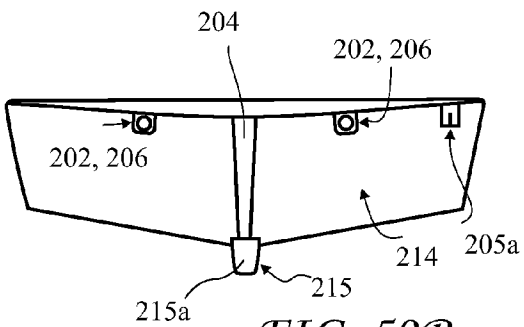
FIG. 50B shows a cross-sectional view of the fourth embodiment of the rescue boat with a first removable keel according to the present invention taken along line 50B-50B of FIG. 45.
Figure 50A:
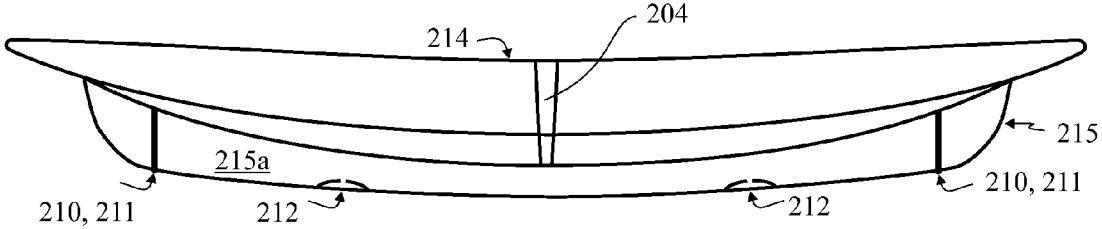
FIG. 50A shows a cross-sectional view of the fourth embodiment of the rescue boat with a first removable keel according to the present invention taken along line 50A-50A of FIG. 45.

FIG. 50A shows a cross-sectional view of the rescue boat 214 with a first shallow removable keel 215*a* taken along line 50A-50A of FIG. 45, and FIG. 50B shows a cross-sectional view of the rescue boat with a first removable keel according to the present invention taken along line 50B-50B of FIG. 45. Bolts 210 pass through holes 211 in the hollow keel 215*a* and into the threaded holes 205*b* for retaining the keel 215*a*.

Figure 51A:
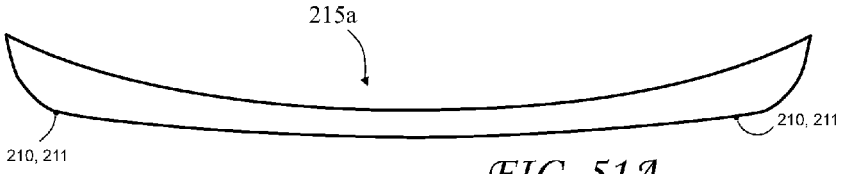
FIG. 51A shows a side view of a shallow removable keel according to the present invention separated from the rescue boat.
Figure 51B:
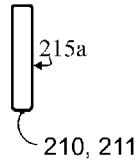
FIG. 51B shows a bow view of the shallow removable keel according to the present invention separated from the rescue boat.

FIG. 51A shows a side view of the shallow removable keel 215*a* separated from the rescue boat 214 and FIG. 51B shows a bow view of the removable keel 215*a*.

Figure 52A:
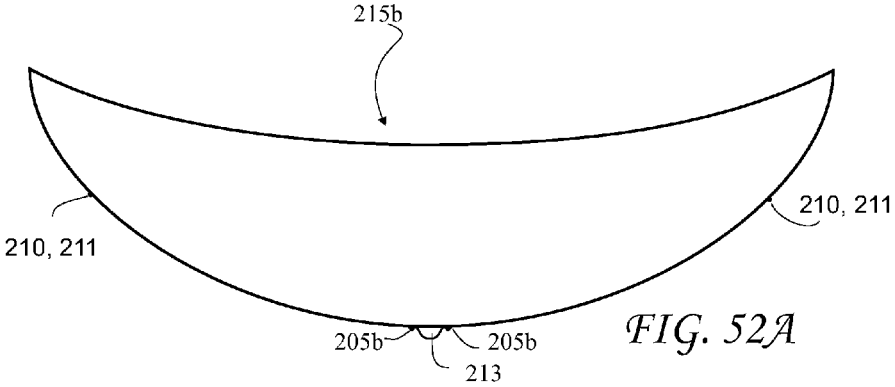
FIG. 52A shows a side view of a deep removable keel according to the present invention separated from the rescue boat.
Figure 52B:
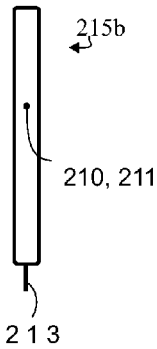
FIG. 52B shows a side view of the deep removable keel according to the present invention separated from the rescue boat.

FIG. 52A shows a side view of a deep removable keel 215*b* separated from the rescue boat 214 and FIG. 52B shows a side view of the deep removable keel 215*b*. Such deep removable keel 215*b* provides advantages for swimmers and especially diver carrying heavy equipment by stabilizing the rescue boat 214. A loop 213 and additional threaded holes 205*b* may be provided to attachment of an anchor or other equipment.

Figure 53:
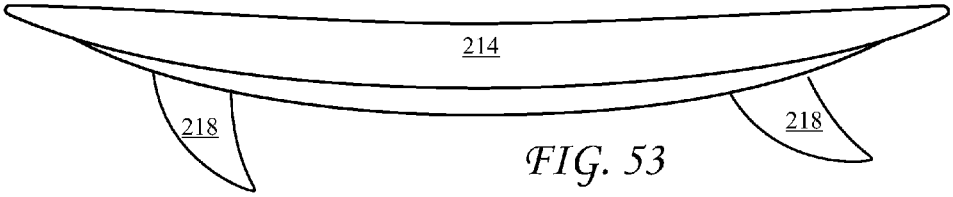
FIG. 53 shows an embodiment of the rescue boat according to the present invention with fins added.

FIG. 53 shows an embodiment of the rescue boat 214 with fins 218 attached to the bottom of the keel 215 for additional stability.

One embodiment of the boat 10*a* is constructed using a novel method to provide a light weight and rugged boat. The method includes steps of: covering the interiors of a mold top section and a mold bottom section with contact cement; laying fiberglass in the mold sections over the contact cement; applying resin to the fiberglass in keel portions of the mold interiors; laying a barrier over the keel portion to make a hollow keel; adding fiberglass over barrier; inserting plastic tubing sections into the mold top section to mold rope passages into the interior of the rescue boat; placing the mold top section onto the mold bottom section; pouring foam into mold; letting the foam expand, harden, and penetrate into the fiberglass; separating the mold sections; and applying a coat of a flexible resin to the exposed fiberglass of the rescue boat. The barrier over the keel portion is preferably convex or half round to increase the empty volume of the keel. The keel is formed with at least one port, and preferably two vertically spaced apart ports to allow water to enter and exit the hollow keel. The step of covering the mold interiors with contact cement is preferably performed by spraying the contact cement onto the interior surfaces of the molds. The resin applied to the exterior is preferably a colored resin to color the exterior of the boat. While fiberglass is a preferred cloth molding material, the cloth used may also be graphite cloth, carbon fiber cloth, or any other suitable cloth. A boat constructed according to the present invention is very light and strong because the foam partially saturates the fiberglass reducing the amount of resin in the boat. The foam is preferably a close cell marine foam, referred to as a floatation foam, a two part pour foam, and Coast Guard approved, for example, 1117 foam made by Revchem Plastics in Bloomington, Calif.

Another embodiment of the rescue boat is constructed in a spin mold to provide minimize weight and no seams. The volume inside the rescue boat 214 is approximately four to five cubic feet. About two cubic feet (in solid form) of liquid state foam is poured into the formed rescue boat 214 and expands evenly to cover the bottom of the inside of the rescue boat 214 which provides buoyancy. It is not necessary to fill the rescue boat 214 completely with the foam for two reasons: 1) Additional foam adds unnecessary weight to the boat; and 2) If the rescue boat 214 is filled completely the foam, the deck 214*b* become warped and indented under the weight of a riders standing on the rescue boat 214.

While the invention herein disclosed has been described by means of specific embodiments and applications thereof, numerous modifications and variations could be made thereto by those skilled in the art without departing from the scope of the invention set forth in the claims.

I claim:

1. A multi-purpose boat comprising:

a bow;

a stern;

between approximately six and ten foot length;

between approximately three and six foot width at a widest point;

between approximately six and sixteen inches overall height;

a hollow keel along the bottom;

a ballast volume in the keel;

at least one port in the bottom of the keel placing the ballast volume in fluid communication with surrounding water;

a concave deck; and a vertical passage generally centered in the concave deck of the multi-purpose boat reaching from the deck and fluidly connected to the ballast volume allowing water to drain from the concave deck to the ballast volume.

2. The boat of claim 1, wherein the hollow keel includes two horizontally spaced apart ports allowing water to enter the keel.

3. The boat of claim 2, wherein the boat weighs not more than approximately 25 pounds when dry and the hollow keel fills with at least 15 pounds of water when the boat is in the water.

4. The boat of claim 2, wherein the boat weighs not more than approximately 25 pounds when dry and the hollow keel fills with approximately 25 pounds of water when the boat is in the water.

5. The boat of claim 1, wherein the hollow keel is removable.

6. The boat of claim 5, wherein the keel is one of a shallow removable keel and a deep removable keel.

7. The boat of claim 1, wherein the boat is formed from plastic in a spin mold.

8. The boat of claim 1, wherein the boat includes an air valve and the boat is inflated with low pressure air.

9. The boat of claim 1, wherein the boat contains about two cubic feet of foam for buoyancy.

10. The boat of claim 1, wherein the foam resides in the bottom of the boat.

11. A multi-purpose boat comprising:

a weight of about 25 pounds and having an empty volume of between four and five cubic feet;

a bow;

a stern;

between approximately six and ten foot length;

between approximately three and six foot width at a widest point;

between approximately six and sixteen inches overall height;

about two cubic feet of foam residing in the bottom of the boat;

a removable hollow keel along the bottom;

a ballast volume in the keel;

two spaced apart ports in the bottom of the keel placing the ballast volume in fluid communication with surrounding water;

a concave deck; and a vertical passage generally centered in the concave deck of the multi-purpose boat reaching from the deck and fluidly connected to the ballast volume allowing water to drain from the concave deck to the ballast volume.

12. A multi-purpose boat comprising:

a hull formed from plastic in a spin mold and having a weight of about 25 pounds and having an empty volume of between four and five cubic feet;

a bow;

a stern;

between approximately six and ten foot length;

between approximately three and six foot width at a widest point;

between approximately six and sixteen inches overall height;

about two cubic feet of foam residing in the bottom of the boat;

an air valve and the boat inflated with low pressure air;

a removable hollow keel along the bottom;

a ballast volume in the keel;

two spaced apart ports in the bottom of the keel placing the ballast volume in fluid communication with surrounding water;

a concave deck; and a vertical passage generally centered in the concave deck of the multi-purpose boat reaching from the deck and fluidly connected to the ballast volume allowing water to drain from the concave deck to the ballast volume.

* * * * *